US012618557B2

(12) United States Patent
Weaver et al.

(10) Patent No.: US 12,618,557 B2
(45) Date of Patent: May 5, 2026

(54) BURNER APPARATUS

(71) Applicant: Honeywell International Inc., Charlotte, NC (US)

(72) Inventors: Joshua Weaver, Yorktown, IN (US); Edward Lovett, Parker City, IN (US); Bradley Wright, Hartford City, IN (US); Timothy Moore, Parker, IN (US); Christopher Eldridge, Albany, IN (US)

(73) Assignee: Honeywell International Inc., Charlotte, NC (US)

( * ) Notice: Subject to any disclaimer, the term of this patent is extended or adjusted under 35 U.S.C. 154(b) by 9 days.

(21) Appl. No.: 18/893,676

(22) Filed: Sep. 23, 2024

(65) Prior Publication Data

US 2026/0085833 A1 Mar. 26, 2026

(51) Int. Cl.
*F23D 14/24* (2006.01)
*F23D 11/40* (2006.01)

(52) U.S. Cl.
CPC ..... *F23D 14/24* (2013.01); *F23D 11/408* (2013.01); *F23C 2201/30* (2013.01)

(58) Field of Classification Search
CPC .... F23R 3/14; F23R 3/286; F23R 3/30; F23R 3/32; F23R 3/34; F23R 3/343; F23D 14/06; F23D 14/22; F23D 11/105; F23D 11/107; F23D 11/383; F23D 14/24; F23D 11/408; F23C 2201/30
See application file for complete search history.

(56) References Cited

U.S. PATENT DOCUMENTS 4,505,666 A * 3/1985 Martin ..... F23D 14/22 431/285
5,275,554 A 1/1994 Faulkner
6,238,203 B1 5/2001 Koh
6,238,206 B1 5/2001 Cummings, III et al.
(Continued)

FOREIGN PATENT DOCUMENTS

CN 105627304 A 6/2016
CN 111649323 B 6/2023

OTHER PUBLICATIONS

Access Combustion, "Model KX Burner (Brochure)" Rev. 010123 retrieved from the Internet at https://storage.googleapis.com/wzukusers/user-25833576/documents/0398712ad88c4c2aada82c674e1d9e9a/Model%20KX%20Tech%20Brochure%20010123.pdf on Jun. 4, 2025, 9 pages.

*Primary Examiner* — Kyle Robert Thomas
(74) *Attorney, Agent, or Firm* — Alston & Bird LLP

(57) ABSTRACT

A burner apparatus is disclosed. The burner apparatus comprising a tube having a proximal portion, a middle portion, and a distal portion, a fuel inlet port adapted to receive fuel inside the tube. The fuel inlet port splits into a first conduit and a second conduit, an air inlet port receives air inside the tube, at least one air swirler unit positioned at the middle portion of the tube, generates a swirling air flow and an axial air flow from the air received, a block having a plurality of staged fuel tips, receives fuel from the second conduit. The block discharges a primary flame by containing the fuel received from the first conduit and the swirling air flow, and provide for a secondary flame by directing the fuel received from the plurality of staged fuel tips into the primary flame downstream of the primary flame attachment point.

13 Claims, 4 Drawing Sheets

(56) References Cited

U.S. PATENT DOCUMENTS

| | | | | |
|---|---|---|---|---|
| 6,394,792 | B1 * | 5/2002 | McDonald | F23M 5/025 239/427.3 |
| 7,104,251 | B2 * | 9/2006 | Kim | F02B 31/04 123/306 |
| 7,632,090 | B2 | 12/2009 | Li et al. | |
| 7,878,798 | B2 | 2/2011 | Poe et al. | |
| 8,480,394 | B2 * | 7/2013 | Daneri | F23C 6/047 431/278 |
| 8,485,813 | B2 | 7/2013 | Feese et al. | |
| 9,534,788 | B2 * | 1/2017 | Li | F23R 3/14 |
| 11,578,865 | B2 * | 2/2023 | Zink | F23C 9/006 |
| 11,747,013 | B2 | 9/2023 | Carroll et al. | |
| 2002/0197574 | A1 * | 12/2002 | Jones | F23D 14/22 431/9 |

* cited by examiner

BURNER APPARATUS

TECHNOLOGICAL FIELD

Example embodiments of the present disclosure relate generally to an industrial burner, and more particularly, to a burner apparatus and a method thereof.

BACKGROUND

Industrial burners play a crucial role in reducing emissions in thermal processes, particularly with the use of low NOx burners, which are among the most cost-effective solutions for minimizing NOx emissions. However, achieving low CO emissions is also essential due to CO's toxicity and combustibility. Various strategies are employed to reduce NOx and CO emissions, such as using high excess air, premixing fuel and air, or flue gas recycling. These strategies, while effective, come with trade-offs, including decreased thermal efficiency, limited operational windows, and potential corrosion or CO issues. Fuel staging is another technique often applied to reduce NOx, especially in applications above auto-ignition temperatures. However, it can be less effective below auto-ignition without the aid of flue gas recycling or other compromises. A new approach allows fuel staging to be used effectively across a wider range of temperatures, both above and below auto-ignition, without relying on flue gas recycling, while maintaining a wide thermal turndown. Such approach offers a more versatile and cost-effective solution for reducing emissions in various industrial thermal applications.

The inventors identified numerous deficiencies and problems in in existing technologies and processes, which are the subjects of embodiments described herein. Through applied effort, ingenuity, and innovation, many of these deficiencies and problems have been solved by developing solutions that are included in embodiments of the present disclosure, many examples of which are described in detail herein.

BRIEF SUMMARY

The following presents a summary of some example embodiments to provide a basic understanding of some aspects of the present disclosure. This summary is not an extensive overview and is intended to neither identify key or critical elements nor delineate the scope of such elements. It will also be appreciated that the scope of the disclosure encompasses many potential embodiments in addition to those here summarized, some of which will be further described in the detailed description that is presented later.

In an example embodiment, a burner apparatus is disclosed. The burner apparatus comprising a tube having a proximal portion, a middle portion, and a distal portion, a fuel inlet port at the proximal portion of the tube, positioned coaxially within the tube and adapted to receive fuel inside the tube. Further, the fuel inlet port further splits into a first conduit and a second conduit, an air inlet port at the proximal portion of the tube, and positioned perpendicular to the fuel inlet port. Further, the air inlet port is adapted to receive air inside the tube, at least one air swirler unit positioned at the middle portion of the tube and mounted around the first conduit. Further, the at least one air swirler unit is configured to generate a swirling air flow and an axial air flow from the air received through the air inlet port, a block positioned at the distal portion of the tube and having a plurality of staged fuel tips arranged around a periphery of the block. Further, each of the plurality of staged fuel tips are configured to receive fuel from the second conduit. Further, the block is configured to discharge a primary flame by containing the fuel received from the first conduit and the swirling air flow, and provide for a secondary flame by directing the fuel received from the plurality of staged fuel tips into the primary flame downstream of the primary flame attachment point.

In some embodiments, the first conduit is positioned along the proximal portion and the middle portion of the tube and the second conduit bypasses the middle portion and merges at the distal portion of the tube.

In some embodiments, an air body positioned at the middle portion of the tube. Further, the air body receives the air from the air inlet port and directs the air towards the at least one air swirler unit.

In some embodiments, the at least one air swirler unit comprises a swirler base and a plurality of swirl vanes attached along a periphery of the swirler base. Further, the swirler base and the plurality of swirl vanes are configured to divide the air into the swirling air flow and the axial air flow, respectively. Further, the swirling air flow comprises an axial component and a tangential component, generated by each of the plurality of swirl vanes.

In some embodiments, at least one fuel nozzle coupled to the first conduit at the distal portion of the tube and fabricated with a plurality of nozzle tips. Further, each of the plurality of nozzles tips is configured to discharge the fuel to the distal portion of the tube to mix with the axial air flow. In some embodiments, a throat positioned around a periphery of the at least one fuel nozzle. Further, the axial air flow discharged from the at least one air swirler unit mixes with the fuel discharged from the at least one fuel nozzle at the throat of the tube.

In some embodiments, a reduction unit positioned between the at least one air swirler unit and the throat of the tube, and configured to direct the swirling air flow towards the throat.

In some embodiments, a stabilization disc attached at the distal portion of the tube. Further, the stabilization disc is configured to reduce velocity of the mixture of the swirling air flow and the fuel to a flame velocity that stabilizes the primary flame.

In some embodiments, a fuel manifold coupled to the second conduit at the distal portion of the tube and connected to each of the plurality of staged fuel tips. Further, the fuel manifold is configured to transfer the fuel from the second conduit to each of the plurality of staged fuel tips.

In some embodiments, the plurality of staged fuel tips is fabricated at a predefined angle. Further, each of the plurality of staged fuel tips are configured to discharge the fuel into a plurality of flow paths. Further, the plurality of flow paths is created around an outer circumference of a discharge section of the block. In some embodiments, the discharge section of the discharge block is further configured to provide shelter to the primary flame from an environment to resist the primary flame from changing temperature and cross-velocities.

In some embodiments, the swirling air flow generated from the at least one air swirler unit exists from an outer periphery of the discharge section to create a recirculation zone in proximity to the plurality of flow paths. Further, the recirculation zone is configured to draw reduced oxygen flue gases and the fuel received from the plurality of staged fuel tips into the primary flame.

In another example embodiment, a method is disclosed. The method comprising receiving, via a fuel inlet port positioned coaxially at a proximal portion of a tube, fuel inside the tube. Further, the fuel inlet port further splits into a first conduit and a second conduit. The method further comprises receiving, via an air inlet port positioned at the proximal portion of the tube, and positioned perpendicular to the fuel inlet port, air inside the tube; generating, via at least one air swirler unit positioned at a middle portion of the tube and mounted around the first conduit, a swirling air flow and an axial air flow from the air received through the air inlet port; and receiving, via each of a plurality of staged fuel tips arranged around a periphery of a block that is positioned at a distal portion of the tube, fuel from the second conduit. Further, the block is configured to discharge a primary flame by containing the fuel received from the first conduit and the axial air flow, and provide for a secondary flame by directing the fuel received from the plurality of staged fuel tips into the primary flame downstream of the primary flame attachment point.

The above summary is provided merely for purposes of summarizing some exemplary embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

Figure 1A:
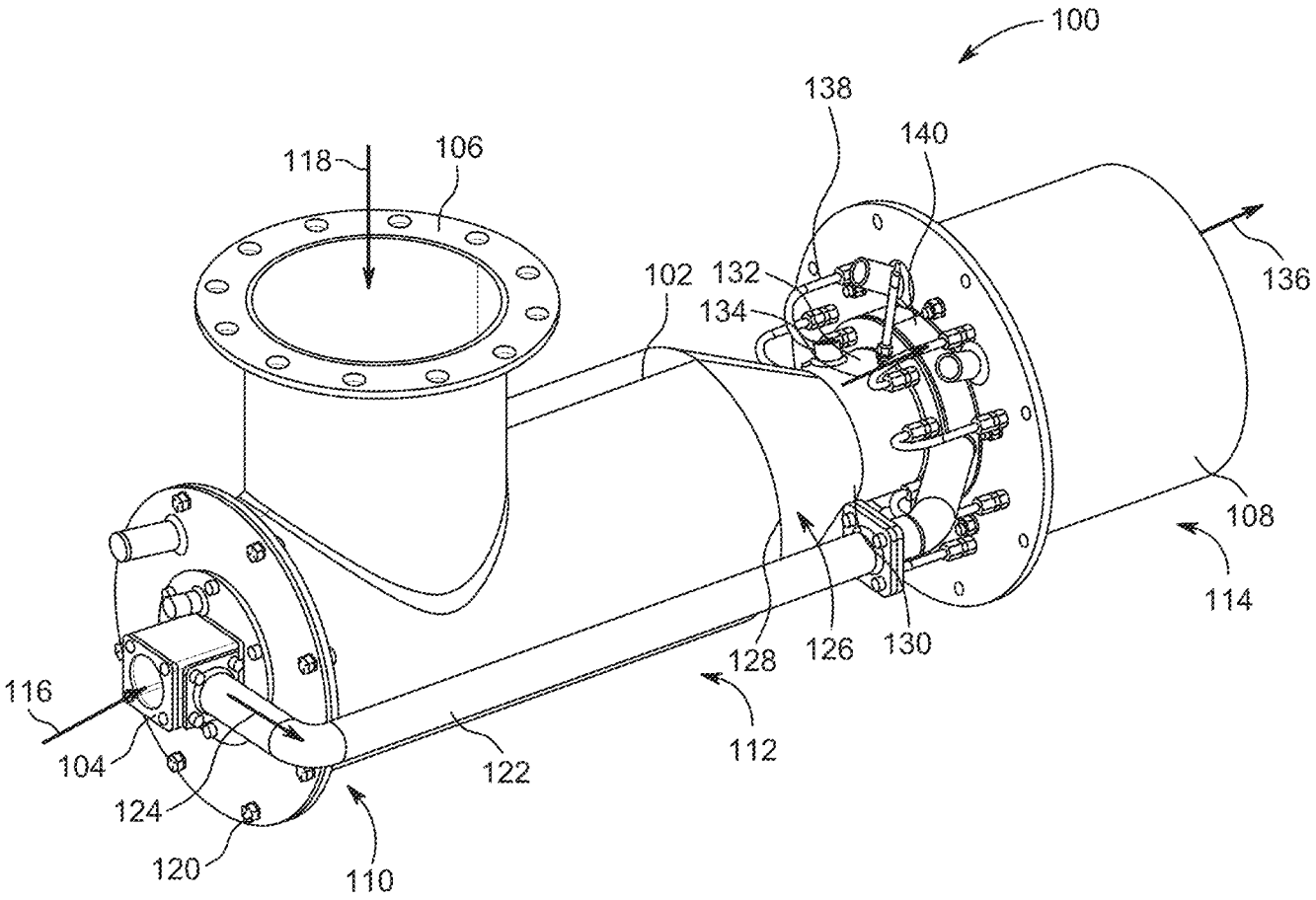
Figure 1B:
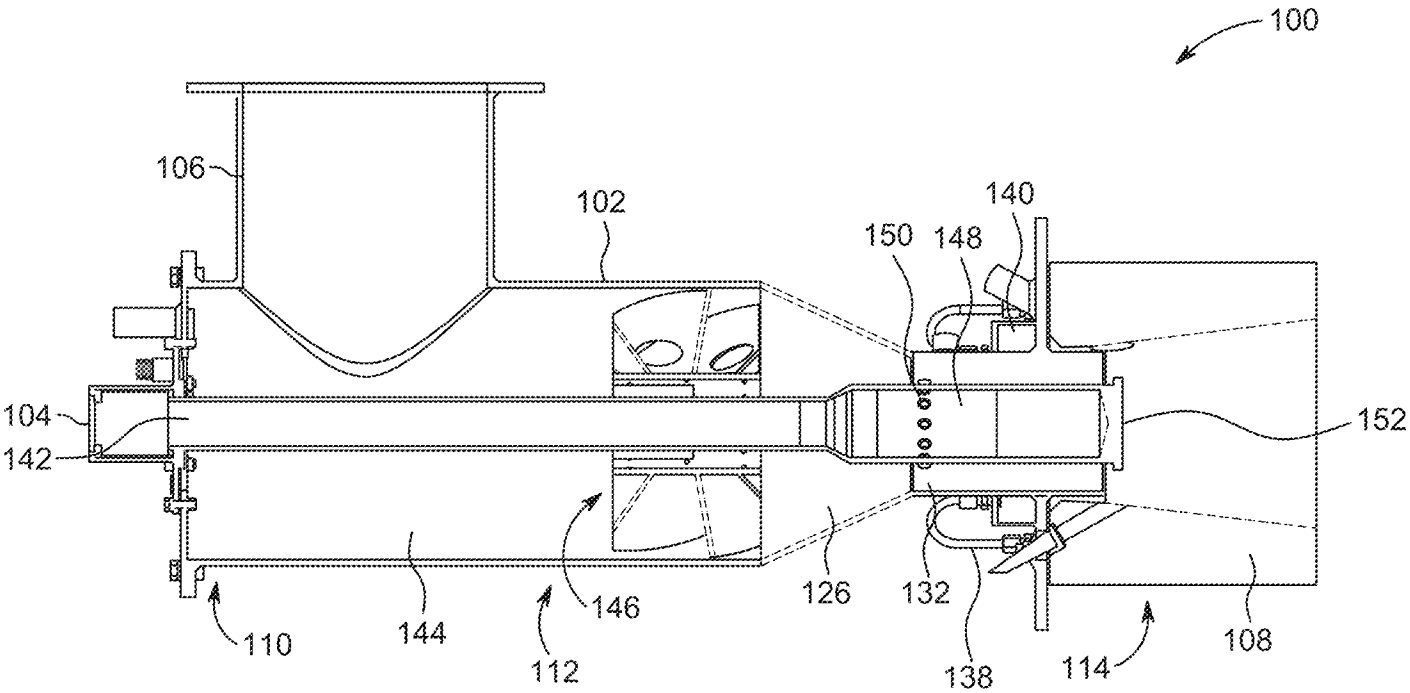
Figure 2:
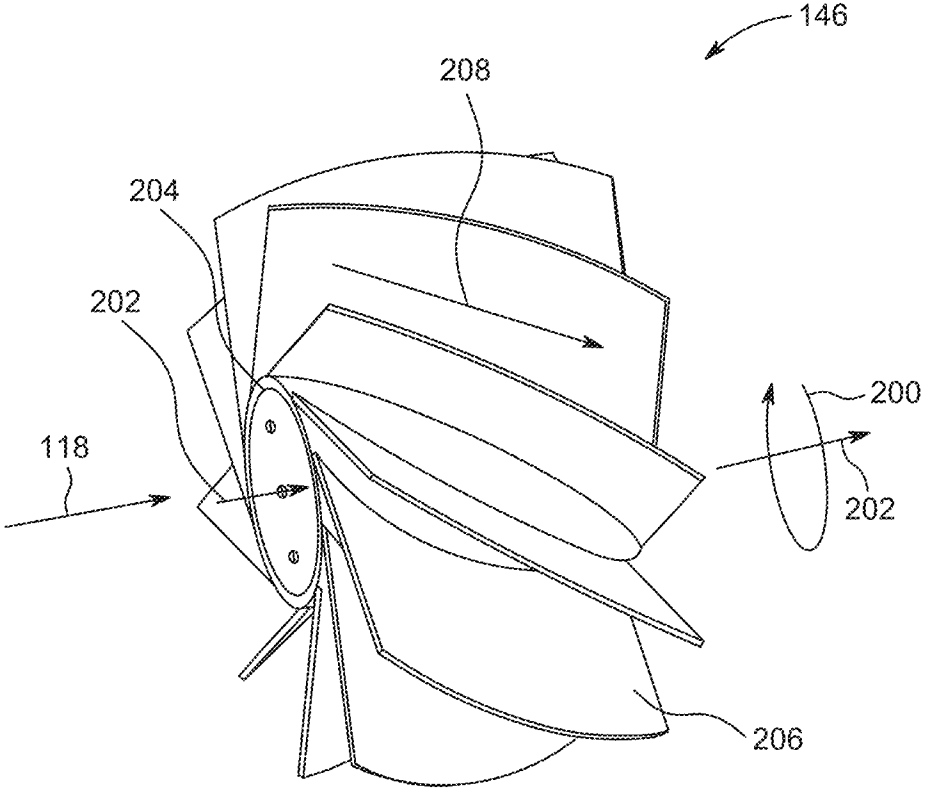
Figure 3:
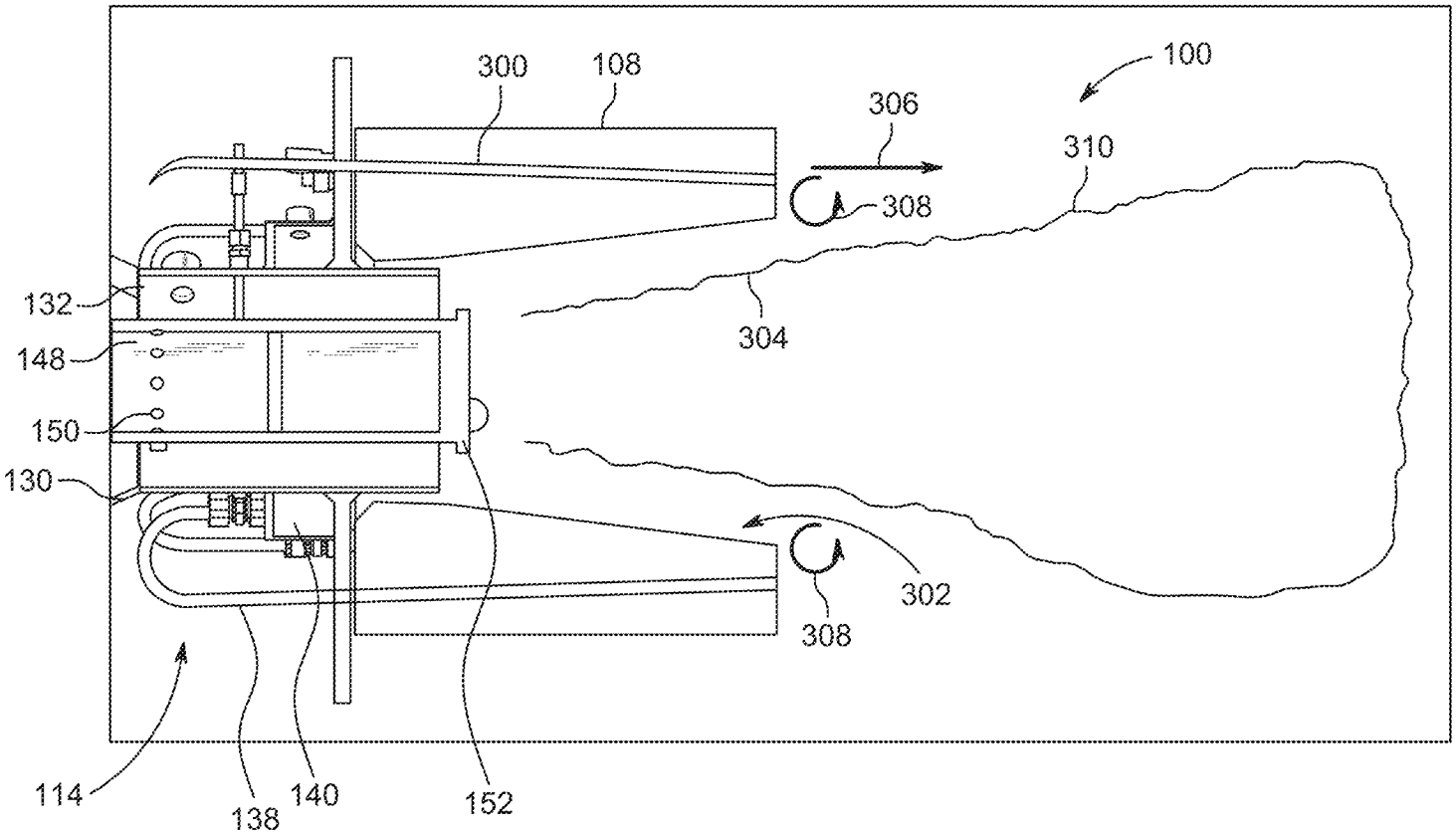

Having thus described certain example embodiments of the present disclosure in general terms, reference will hereinafter be made to the accompanying drawings, which are not necessarily drawn to scale, and wherein:

FIG. 1A illustrates an isometric view of a burner apparatus in accordance with an example embodiment of the present disclosure;

FIG. 1B illustrates a sectional side view of the burner apparatus in accordance with an example embodiment of the present disclosure;

FIG. 2 illustrates a perspective view of at least one air swirler unit of the burner apparatus in accordance with an example embodiment of the present disclosure; and FIG. 3 illustrates another sectional side view of the burner apparatus in accordance with an example embodiment of the present disclosure.

DETAILED DESCRIPTION

Some embodiments will now be described more fully hereinafter with reference to the accompanying drawings, in which some, but not all, embodiments of the present disclosure are shown. Indeed, various embodiments may be embodied in many different forms and should not be construed as limited to the embodiments set forth herein; rather, these embodiments are provided so that this disclosure will satisfy applicable legal requirements.

The components illustrated in the figures represent components that may or may not be present in various embodiments of the present disclosure described herein such that embodiments may include fewer or more components than those shown in the figures while not departing from the scope of the present disclosure. Some components may be omitted from one or more figures or shown in dashed line for visibility of the underlying components.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

The phrases "in various embodiments," "in one embodiment," "according to one embodiment," "in some embodiments," and the like generally mean that the particular feature, structure, or characteristic following the phrase may be included in at least one embodiment of the present disclosure and may be included in more than one embodiment of the present disclosure (importantly, such phrases do not necessarily refer to the same embodiment).

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such a component or feature may be optionally included in some embodiments or it may be excluded.

The present disclosure provides various embodiments of a burner apparatus. Embodiments of the present disclosure may comprise a tube having a proximal portion, a middle portion, and a distal portion. Embodiments of the present disclosure may comprise a fuel inlet port that may be positioned coaxially at the proximal portion of the tube, and may be adapted to receive fuel inside the tube. The fuel inlet port may further splits into a first conduit and a second conduit. Embodiments of the present disclosure may comprise an air inlet port that may be positioned at the proximal portion of the tube, and may be positioned perpendicular to the fuel inlet port. The air inlet port may be adapted to receive air inside the tube. Embodiments of the present disclosure may comprise at least one air swirler unit that may be positioned at the middle portion of the tube and may be mounted around the first conduit. The at least one air swirler unit may be configured to generate a swirling air flow and an axial air flow from the air received through the air inlet port. Embodiments of the present disclosure may comprise a block that may be positioned at the distal portion of the tube and having a plurality of staged fuel tips arranged around a periphery of the block. Each of the plurality of staged fuel tips may be configured to receive fuel from the second conduit. The block may be configured to discharge a primary flame by containing the fuel received from the first conduit and the swirling air flow, and provide for a secondary flame by directing the fuel received from the plurality of staged fuel tips into the primary flame downstream of the primary flame attachment point.

FIG. 1A illustrates an isometric view of a burner apparatus 100, in accordance with an example embodiment of the present disclosure. FIG. 1B illustrates a sectional side view of the burner apparatus 100, in accordance with an example embodiment of the present disclosure.

In some embodiments, the burner apparatus 100 may comprise a tube 102, a fuel inlet port 104, an air inlet port 106, and a block 108. In some embodiments, the burner apparatus 100 may be configured to generate heat by burning fuel. Further, the fuel may comprise at least one of natural gas, oil, coal, or biomass. In various examples, the heat generated by the burner apparatus 100 may be used for various processes such as heating, melting, drying, or other applications. In some embodiments, the burner apparatus 100 may be installed within a furnace (not shown). Further, the furnace may be installed within a facility (not shown). The facility may comprise industries such as manufacturing, food processing, chemical processing, and power generation. In various examples, the burner apparatus 100 may be connected with a fuel source (not shown) and an air supply system (not shown). Further, the burner apparatus 100 may be configured to receive, mix, and ignite the fuel and air to combust a fuel-air mixture and generate heat.

In some embodiments, the burner apparatus 100 may comprise the tube 102. Further, the tube 102 may be configured to encase one or more components of the burner apparatus 100. In some embodiments, the tube 102 may be configured to protect the one or more components of the burner apparatus 100 from various external factors. The external factors may comprise dust, moisture, and physical damage. In some embodiments, the tube 102 of the burner apparatus 100 may be constructed with various materials. The materials may comprise at least one of an aluminum, stainless steel, etc. Further, the materials of the tube 102 may be selected such that the tube 102 of the burner apparatus 100 may withstand one or more harsh conditions. In various examples, the materials of the tube 102 may be selected to prevent the heat generated by combustion of the fuel-air mixture may not escape the burner apparatus 100. The conditions may comprise at least one of a high temperature, pressure fluctuations, and exposure to corrosive materials. Further, the tube 102 of the burner apparatus 100 may be constructed with a shape that includes, but is not limited to, a cylindrical shape, cuboidal shape, or tapered shape.

In some embodiments, the tube 102 of the burner apparatus 100 may comprise a proximal portion 110, a middle portion 112, and a distal portion 114. In some embodiments, the proximal portion 110 of the tube 102 may be connected with the fuel source and the air supply system. In some embodiments, the proximal portion 110 of the tube 102 may be configured to receive fuel from the fuel source, as depicted by an arrow 116. In some embodiments, the proximal portion 110 of the tube 102 may be configured to receive air from the air supply system, as depicted by an arrow 118. In some embodiments, the middle portion 112 of the tube 102 may facilitate mixing of the fuel with the air. In some embodiments, the middle portion 112 may be configured to carry air that may be mixed with the fuel in the distal portion 114 and ignited during a combustion process. In some embodiments, the distal portion 114 of the tube 102 may be positioned inside the furnace. Further, the distal portion 114 of the tube 102 may be configured to release the flame generated during the combustion process, inside the furnace.

In some embodiments, the burner apparatus 100 may comprise the fuel inlet port 104 and the air inlet port 106. In some embodiments, the proximal portion 110 of the tube 102 may be constructed with the fuel inlet port 104 and the air inlet port 106. In various examples, the fuel inlet port 104 of the tube 102 may be positioned coaxially at the proximal portion 110 of the tube 102. In some embodiments, the fuel inlet port 104 may be coupled with the proximal portion 110 of the tube 102 through a plurality of fasteners 120 such as bolted nuts, rivets, screws, etc. In some embodiments, the fuel inlet port 104 of the tube 102 may be coupled with the fuel source. In some embodiments, the fuel inlet port 104 may be configured to receive the fuel from the fuel source. In some embodiments, the fuel inlet port 104 of the tube 102 may be constructed with various shapes. The shapes may include, but is not limited to, a square shape or rectangle shape. In some embodiments, the fuel inlet port 104 of the tube 102 may be configured to receive the fuel inside the tube 102.

In some embodiments, the air inlet port 106 of the tube 102 may be positioned at the proximal portion 110 of the tube 102. In some embodiments, the air inlet port 106 may be positioned perpendicular to the fuel inlet port 104 of the tube 102. In some embodiments, the air inlet port 106 of the tube 102 may be coupled with the air supply system. In some embodiments, the air inlet port 106 of the burner apparatus 100 may be coupled with the proximal portion 110 of the tube 102 through various machining processes. The processes may include, but are not limited to, welding, casting, molding, etc. In some embodiments, the air inlet port 106 may be configured to receive the air from the air supply system. In some embodiments, the air inlet port 106 of the tube 102 may be constructed with various shape. The shapes may include, but is not limited to, a cylindrical shape, a cuboidal shape, a conical shape, etc. In some embodiments, the air inlet port 106 of the tube 102 may be configured to receive the air inside the tube 102.

In some embodiments, the fuel inlet port 104 of the burner apparatus 100 may further split into a first conduit 142 (FIG. 1B) and a second conduit 122. In some embodiments, the first conduit 142 of the fuel inlet port 104 may be configured to receive a portion of the fuel received from the fuel inlet port 104. In some embodiments, the first conduit 142 may be positioned inside the tube 102 of the burner apparatus 100, as illustrated in FIG. 1B. In some embodiments, the first conduit 142 may be positioned along the proximal portion 110 and the middle portion 112 of the tube 102. In some embodiments, the first conduit 142 may be configured to carry the fuel from the proximal portion 110 to the distal portion 114 of the tube 102 via the middle portion 112 of the tube 102. In some embodiments, the first conduit 142 of the burner apparatus 100 may be constructed with various materials. The materials may include, but are not limited to, metals such as stainless steel, alloys, ceramics, composite materials, etc. In some embodiments, the material of the first conduit 142 may be selected to make the first conduit 142 compatible to each type of the fuel, thermal resistant, durable under high-temperature conditions.

In some embodiments, the second conduit 122 of the fuel inlet port 104 may be configured to receive another portion of the fuel received from the fuel inlet port 104. In some embodiments, the second conduit 122 may be positioned outside the tube 102 of the burner apparatus 100, as illustrated in FIG. 1A. In some embodiments, the second conduit 122 may be configured to bypass the middle portion 112 of the tube 102 and merge at the distal portion 114 of the tube 102. In some embodiments, the second conduit 122 may be configured to carry the fuel from the proximal portion 110 to the distal portion 114 of the tube 102, as depicted by an arrow 124. In some embodiments, the second conduit 122 of the burner apparatus 100 may be constructed with various materials. The materials may include, but are not limited to, metals such as stainless steel, alloys, ceramics, composite materials, etc. In some embodiments, the material of the second conduit 122 may be selected to make the second conduit 122 compatible to each type of the fuel, thermal resistant, durable under high-temperature conditions.

In some embodiments, the air inlet port 106 of the tube 102 may be configured to receive the air inside the tube 102. In some embodiments, the middle portion 112 of the tube 102 may be configured to receive the air from the air inlet port 106. In some embodiments, the burner apparatus 100 may comprise an air body 144 (FIG. 1B). In some embodiments, the air body 144 may be positioned at the middle portion 112 of the tube 102. In some embodiments, the air body 144 may be configured to receive the air from the air inlet port 106 and directs the air towards the distal portion 114 of the tube 102. In some embodiments, the air body 144 of the burner apparatus 100 may define a shape similar to the shape of the middle portion 112 of the tube 102. In some embodiments, the middle portion 112 of the tube 102 may comprise at least one air swirler unit 146 (FIG. 1B). In some embodiments, the at least one air swirler unit 146 may be positioned at the middle portion 112 of the tube 102. In some embodiments, the at least one air swirler unit 146 may be mounted around the first conduit 142. In some embodiments, the at least one air swirler unit 146 may be configured to generate a swirling air flow and an axial air flow from the air received through the air inlet port 106. In some embodiments, the at least one air swirler unit 146 may define a rotating axis. In some embodiments, the at least one air swirler unit 146 may be configured to rotate on the rotating axis. In some embodiments, the at least one air swirler unit 146 may be configured to receive the air from the air body 144 and direct the air towards the distal portion 114 of the tube 102. In some embodiments, the at least one air swirler unit 146 may be configured to direct the air towards the distal portion 114 of the tube 102 with an enhanced velocity.

In some embodiments, the middle portion 112 of the tube 102 may comprise a reduction unit 126. In some embodiments, the reduction unit 126 may be configured to receive the air having the swirling air flow and the axial air flow from the at least one air swirler unit 146. In some embodiments, the reduction unit 126 of the burner apparatus 100 may be constructed with various shapes. The shapes may include, but are not limited to, a tapered shape, a conical shape, etc. In some embodiments, the shape of the reduction unit 126 may facilitate in increasing velocity of the air moving from the middle portion 112 of the tube 102 to the distal portion 114 of the tube 102. In some embodiments, the reduction unit 126 may comprise a first end 128 and a second end 130. In some embodiments, the first end 128 of the reduction unit 126 may be configured to receive air from the at least one air swirler unit 146. In some embodiments, the second end 130 of the reduction unit 126 may be configured to release the air with the increased velocity towards the distal portion 114 of the tube 102. In various examples, a diameter defined by the first end 128 of the reduction unit 126 is greater than a diameter defined by the second end 130 of the reduction unit 126, thereby increasing the velocity of the air.

In some embodiments, the burner apparatus 100 may comprise a throat 132. In some embodiments, the throat 132 may be coupled between the reduction unit 126 and the block 108. In some embodiments, the throat 132 may be coupled with the second end 130 of the reduction unit 126. In some embodiments, the burner apparatus 100 may comprise at least one fuel nozzle 148 (FIG. 1B). In some embodiments, the at least one fuel nozzle 148 may be coupled with the first conduit 142 at the distal portion 114 of the tube 102. In some embodiments, the throat 132 may be configured to encase the at least one fuel nozzle 148. In some embodiments, the at least one fuel nozzle 148 may be configured to discharge the fuel received from the first conduit 142 into the throat 132. In some embodiments, the at least one fuel nozzle 148 may comprise a plurality of nozzle tips 150 (FIG. 1B). In some embodiments, the plurality of nozzle tips 150 may be circumferentially fabricated around a periphery of the at least one fuel nozzle 148. In some embodiments, the plurality of nozzle tips 150 of the at least one fuel nozzle 148 may be configured to discharge the fuel into the throat 132 containing the air received from the reduction unit 126. In some embodiments, the fuel discharged from the plurality of nozzle tips 150 may be configured to mix with the axial air flow contained within the throat 132. Further, the mixture of the fuel and the axial air may be configured to move along the distal portion 114 of the tube 102, as depicted by an arrow 134.

In some embodiments, the distal portion 114 of the tube 102 may comprise the block 108. In some embodiments, the block 108 may be configured to receive the mixture of the fuel and the axial air to generate a primary flame 304 (FIG. 3). In some embodiments, the block 108 of the burner apparatus 100 may be configured to discharge the primary flame 304 by containing the fuel received from the first conduit 142 and axial air. In some embodiments, the block 108 may be configured to discharge the primary flame 304 outwards from the block 108 of the burner apparatus 100, as depicted by an arrow 136. In some embodiments, the burner apparatus 100 may further comprise a stabilization disc 152 (FIG. 1B). In some embodiments, the stabilization disc 152 may be attached at the distal portion 114 of the tube 102. In some embodiments, stabilization disc 152 may be configured to reduce velocity of the mixture of the swirling air flow and the fuel to a flame velocity. In some embodiments, the stabilization disc 152 of the burner apparatus 100 may be configured to stabilize the primary flame 304 by reducing velocity of the mixture of the swirling air flow and the fuel.

In some embodiments, the block 108 may comprise a plurality of staged fuel tips 138. In some embodiments, the plurality of staged fuel tips 138 may be arranged circumferentially around a periphery of the block 108. In some embodiments, the each of the plurality of fuel tips 138 may be configured to receive the another portion of the fuel from the second conduit 122. In some embodiments, the second conduit 122 coupled with the fuel inlet port 104 may be configured to receive the fuel. In some embodiments, the burner apparatus 100 may further comprise a fuel manifold 140. In some embodiments, the fuel manifold 140 may be positioned at the distal portion 114 of the tube 102. In some embodiments, the second conduit 122 may be coupled with the fuel manifold 140. In some embodiments, the second conduit 122 may be configured to transfer the fuel to the fuel manifold 140. In some embodiments, the fuel manifold 140 may be positioned adjacent to the block 108. In some embodiments, the fuel manifold 140 may be constructed with various shapes. The shapes may include, but are not limited to, circular shape, etc. In some embodiments, the fuel manifold 140 may be configured to collect the another portion of the fuel around the throat 132. In some embodiments, the fuel manifold 140 may comprise the plurality of staged fuel tips 138. In some embodiments, the fuel manifold 140 may be configured to transfer the fuel from the second conduit 122 to each of the plurality of staged fuel tips 138. Further, the plurality of staged fuel tips 138 may be configured to receive the another portion of the fuel from the fuel manifold 140.

In some embodiments, the block 108 of the burner apparatus 100 may further comprise a plurality of flow paths 300 (FIG. 3). In some embodiments, the plurality of staged fuel tips 138 may be fabricated at a predefined angle (e.g., each of the plurality of staged fuel tips 138 are fabricated at 30 degrees to 45 degrees). In some embodiments, each of the plurality of staged fuel tips 138 may be coupled with a corresponding flow path 300. In some embodiments, each of the plurality of staged fuel tips 138 may be configured to discharge the another portion of the fuel into the plurality of flow paths 300. In some embodiments, the plurality of flow paths 300 of the block 108 may be configured to discharge the fuel into the primary flame 304. Further, the block 108 of the burner apparatus 100 may be configured to provide a secondary flame 310 (FIG. 3) by directing the fuel received from the plurality of staged fuel tips 138 into the primary flame 304 downstream of the primary flame 304 attachment point though the plurality of flow paths 300.

FIG. 2 illustrates a perspective view of the at least one air swirler unit 146 of the burner apparatus 100, in accordance with an example embodiment of the present disclosure.

In some embodiments, the at least one air swirler unit 146 may be positioned at the middle portion 112 of the tube 102. In some embodiments, the at least one air swirler unit 146 may be configured to receive air from the air inlet port 106. In some embodiments, the at least one air swirler unit 146 may be configured to generate the swirling air flow, as depicted by an arrow 200 and the axial air flow, as depicted by an arrow 202. from the air received through the air inlet port 106. In some embodiments, the at least one air swirler unit 146 may define the rotating axis. Further, the at least one air swirler unit 146 may be configured to rotate over the rotating axis. In some embodiments, the at least one air swirler unit 146 may be configured to generate the swirling air flow and the axial air flow from the air received from the air inlet port 106.

In various examples, the at least one air swirler unit 146 may correspond to a motor-powered air swirler unit. Further, the motor-powered air swirler unit may be coupled with a power source (not depicted). Further, the motor-powered air swirler unit may be configured to receive a power supply from a power source and rotate at predefined revolutions per minute (RPM) to generate the swirling air flow and the axial air flow from the air received from the air inlet port 106. In various other examples, the at least one air swirler unit 146 may correspond to a self-powered air swirler unit. Further, the self-powered air swirler unit may be configured to harness a force generated by the air received through the air inlet port 106. Further, the force generated by the air received through the air inlet port 106 may facilitate the self-powered air swirler unit to rotate thereby generating the swirling air flow and the axial air flow from the air received from the air inlet port 106.

In some embodiments, the at least one air swirler unit 146 may comprise a swirler base 204 and a plurality of swirl vanes 206. In some embodiments, each swirl vane of the plurality of swirl vanes 206 may be attached along a periphery of the swirler base 204. In some embodiments, each of the plurality of swirl vanes 206 may be oriented at a predefined angle (e.g. 40 degrees-50 degrees) around the swirler base 204. In some embodiments, the at least one air swirler unit 146 may be configured to rotate in a clockwise or in an anti-clockwise direction around the rotating axis. In some embodiments, the swirler base 204 and the plurality of swirl vanes 206 may be configured to receive air through the air inlet port 106. In some embodiments, the swirler base 204 and the plurality of swirl vanes 206 may be configured to divide the air into the swirling air flow and the axial air flow, respectively. In some embodiments, the swirling air flow may be initially passed through the plurality of swirl vanes 206 of the at least one air swirler unit 146, as shown by an arrow 208. In some embodiments, the swirling air flow may be configured to move perpendicular to the rotating axis of the at least one air swirler unit 146. In some embodiments, the axial air flow may be configured to move parallel to the rotating axis of the at least one air swirler unit 146. In some embodiments, the swirling air flow may comprise an axial component and a tangential component, generated by each of the plurality of swirl vanes 206.

In some embodiments, the axial component of the swirling air flow may correspond to a portion of the air that moves in a direction parallel to the rotating axis of the at least one air swirler unit 146. In some embodiments, the axial component of the swirling air flow may facilitate in directing the air into the throat 132 and ensuring the mixture of the fuel and air may evenly distribute inside the block 108. In some embodiments, the tangential component of the swirling air flow may correspond to another portion of the swirling air flow that moves perpendicular to the rotating axis of the at least one air swirler unit 146. In various examples, the tangential component of the swirling air flow may be depicted in a circular or spiral pattern around the rotating axis of the at least one air swirler unit 146. The tangential component of the swirling air flow may facilitate in a proper mixing of the air and the fuel inside the throat 132.

FIG. 3 illustrates another sectional side view of the burner apparatus 100, in accordance with an example embodiment of the present disclosure.

In some embodiments, the block 108 of the burner apparatus 100 may comprise the plurality of flow paths 300. In some embodiments, each of the flow path 300 may be coupled with a corresponding staged fuel tips 138. In some embodiments, the block 108 of the burner apparatus 100 may comprise a discharge section 302. In some embodiments, the discharge section 302 of the block 108 may be configured to provide a shelter to the primary flame 304 from an environment to resist the primary flame 304 from changing temperature and cross-velocities. In some embodiments, each of the plurality of flow paths 300 may be created around an outer circumference of the discharge section 302 of the block 108. In some embodiments, each of the plurality of staged fuel tips 138 may be configured to discharge the fuel into the corresponding flow path 300. Further, each of the plurality of flow paths 300 may be configured to dispense the fuel into the primary flame 304, as depicted by an arrow 306 and thereby generating the secondary flame 310.

In some embodiments, the block 108 of the burner apparatus 100 may be configured to receive the primary flame 304 having the swirling air flow and the axial air flow. In some embodiments, the swirling air flow generated by the at least one air swirler unit 146 may be configured to exit from an outer periphery of the discharge section 302 of the block 108. In some embodiments, the swirling air flow may be configured to create a recirculation zone in proximity to the plurality of flow paths 300, as depicted by an arrow 308. In some embodiments, the swirling air flow discharging from the block 108 may be configured to create a gap between the outer periphery of the discharge section 302 and an inner periphery of the discharge section 302, thereby creating the recirculation zone. In some embodiments, the recirculation zone may be configured to draw reduced oxygen flue gases and the fuel received from the plurality of staged fuel tips 138 into the primary flame 304 thereby aiding stabilization of the secondary flame 310. In some embodiments, the mixing of the fuel into the primary flame 304 may facilitate in reducing emission of nitrogen oxide (NOx) and carbon monoxide (CO) gases from the burner apparatus 100.

In some embodiments, a method for the burner apparatus 100 is disclosed. The method comprises one or more operations. At an operation, the fuel inlet port 104 that may be positioned coaxially at the proximal portion 110 of the tube 102 may be configured to receive the fuel inside the tube 102. Further, the fuel inlet port 104 may further splits into the first conduit 142 and the second conduit 122. In some embodiments, the first conduit 142 may be positioned along the proximal portion 110 and the middle portion 112 of the tube 102 and the second conduit 122 may bypass the middle portion 112 and merge at the distal portion 114 of the tube 102. At another operation, the air inlet port 106 that may be positioned at the proximal portion 110 of the tube 102, and positioned perpendicular to the fuel inlet port 104 may be configured to receive the air inside the tube 102. At another operation, the at least one air swirler unit 146 positioned at the middle portion 112 of the tube 102 and mounted around the first conduit 142, may be configured to generate the swirling air flow and the axial air flow from the air received through the air inlet port 106. In some embodiments, the at least one air swirler unit 146 may comprise the swirler base 204 and the plurality of swirl vanes 206 that may be attached along the periphery of the swirler base 204. Further, the swirler base 204 and the plurality of swirl vanes 206 may be configured to divide the air into the swirling air flow and the axial air flow, respectively.

At another operation, each of the plurality of staged fuel tips 138 arranged around the periphery of the block 108 that is positioned at the distal portion 114 of the tube 102 may be configured to receive the fuel from the second conduit 122. In some embodiments, the block 108 may be configured to discharge the primary flame 304 by containing the fuel received from the first conduit 142 and the axial air flow, and provide for the secondary flame 310 by directing the fuel received from the plurality of staged fuel tips 138 into the primary flame 304 downstream of the primary flame 304 attachment point.

The present disclosure streamlines a lower emission of nitrogen oxides (NOx) and carbon monoxide gases during the combustion process of the burner apparatus 100. Embodiments of the present disclosure may ensure a good thermal turndown by combining the fuel into the primary flame 304 through the plurality of flow paths 300 at the recirculation zone. The present disclosure utilizes the swirling air flow and the axial air flow of the air received through the air inlet port 106 to combine the fuel into the primary flame 304.

Many modifications and other embodiments of the disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A burner apparatus, comprising:

a tube having a proximal portion, a middle portion, and a distal portion, wherein the middle portion of the tube comprises at least a reduction unit;

a fuel inlet port at the proximal portion of the tube, wherein the fuel inlet port is split into a first conduit and a second conduit, wherein the first conduit is positioned coaxially within the tube and adapted to receive fuel inside the tube, wherein the second conduit bypasses a portion of the tube;

an air inlet port at the proximal portion of the tube, and positioned perpendicular to the fuel inlet port, wherein the air inlet port is adapted to receive air inside the tube;

at least one air swirler unit positioned at the middle portion of the tube and mounted around the first conduit, wherein the at least one air swirler unit is configured to generate a swirling air flow and an axial air flow from the air received through the air inlet port;

the reduction unit positioned downstream of the at least one air swirler unit along a flow of the air, wherein the reduction unit has a tapered shape along the flow of the air, wherein the reduction unit increases a speed of the air received from the at least one air swirler unit;

at least one fuel nozzle coupled to the first conduit at the distal portion of the tube, wherein the at least one fuel nozzle defines a plurality of nozzle tips, wherein the plurality of nozzle tips discharge the fuel from the first conduit into the tube to mix with the air received from the reduction unit, wherein the air received from the reduction unit have increased speed in comparison to the air received by the reduction unit from the at least one air swirler unit; and a block positioned at the distal portion of the tube and downstream of the at least one fuel nozzle, along the flow of the air, wherein the block comprising a plurality of staged fuel tips arranged around a periphery of the block, wherein each of the plurality of staged fuel tips are configured to receive fuel from the second conduit, wherein the block is configured to discharge a primary flame by containing the fuel received from the first conduit and the swirling air flow, and provide for a secondary flame by directing the fuel received from the plurality of staged fuel tips into the primary flame downstream of a primary flame attachment point.

2. The burner apparatus of claim 1, wherein the first conduit is positioned along the proximal portion and the middle portion of the tube and the second conduit bypasses the middle portion and merges at the distal portion of the tube.

3. The burner apparatus of claim 1, further comprising an air body positioned at the middle portion of the tube, wherein the air body receives the air from the air inlet port and directs the air towards the at least one air swirler unit.

4. The burner apparatus of claim 1, wherein the at least one air swirler unit comprises a swirler base and a plurality of swirl vanes attached along a periphery of the swirler base, wherein the swirler base and the plurality of swirl vanes are configured to divide the air into the swirling air flow and the axial air flow respectively, wherein the swirling air flow comprises an axial component and a tangential component, generated by each of the plurality of swirl vanes.

5. The burner apparatus of claim 1, further comprising a throat of the tube positioned around a periphery of the at least one fuel nozzle, wherein the axial air flow discharged from the at least one air swirler unit mixes with the fuel discharged from the at least one fuel nozzle at the throat of the tube.

6. The burner apparatus of claim 5, wherein the reduction unit positioned between the at least one air swirler unit and the throat of the tube.

7. The burner apparatus of claim 1, further comprising a stabilization disc attached at the distal portion of the tube, wherein the stabilization disc is configured to reduce velocity of the mixture of the air and the fuel to a flame velocity that stabilizes the primary flame.

8. The burner apparatus of claim 1, further comprising a fuel manifold coupled to the second conduit at the distal portion of the tube, wherein the fuel manifold is fluidly connected to each of the plurality of staged fuel tips, wherein the fuel manifold is configured to transfer the fuel from the second conduit to each of the plurality of staged fuel tips.

9. The burner apparatus of claim 1, wherein the plurality of staged fuel tips is fabricated at a predefined angle with respect to the first conduit, wherein each of the plurality of staged fuel tips are configured to discharge the fuel into a plurality of flow paths, wherein the plurality of flow paths is created around an outer circumference of a discharge section of the block.

10. The burner apparatus of claim 9, wherein the discharge section of the block is further configured to provide a shelter to the primary flame from an environment to resist the primary flame from changing temperature and cross-velocities.

11. The burner apparatus of claim 9, wherein the swirling air flow generated from the at least one air swirler unit exists from an outer periphery of the discharge section to create a recirculation zone in proximity to the plurality of flow paths, wherein the recirculation zone is configured to draw reduced oxygen flue gases and the fuel received from the plurality of staged fuel tips into the primary flame.

12. The burner apparatus of claim 9, wherein the predefined angle varies in a range between 30 degrees to 45 degrees.

13. The burner apparatus of claim 1, wherein the at least one air swirler unit is configured to rotate based on a force generated by the air received through the air inlet port.

* * * * *